US006354296B1

(12) United States Patent
Baumann et al.

(10) Patent No.: US 6,354,296 B1
(45) Date of Patent: Mar. 12, 2002

(54) ANTI-FOG FACE MASK

(75) Inventors: Nicholas R. Baumann, St. Paul, MN (US); Shannon L. Dowdell, Indianapolis, IN (US); Matt T. Scholz, Woodbury; Wayne K. Dunshee, Maplewood, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/039,731

(22) Filed: Mar. 16, 1998

(51) Int. Cl.[7] ..... A62B 18/02

(52) U.S. Cl. ..... 128/206.19; 128/206.14; 128/206.22; 128/206.25

(58) Field of Search ..... 128/206.19, 201.17, 128/206.21, 206.22, 206.24, 206.25, 863, 206.14

(56) References Cited

U.S. PATENT DOCUMENTS

| | | | | | |
|---|---|---|---|---|---|
| 3,490,447 | A | * | 1/1970 | Jackson | 128/139 |
| 3,603,315 | A | * | 9/1971 | Becker, III | 128/206.19 |
| 3,834,384 | A | * | 9/1974 | Raines | 128/146.2 |
| 3,888,246 | A | * | 6/1975 | Lauer | 128/146.2 |
| 3,890,966 | A | | 6/1975 | Aspelin et al. | 128/146.2 |
| 3,974,829 | A | | 8/1976 | Tate, Jr. | 128/146.2 |
| 4,037,593 | A | | 7/1977 | Tate, Jr. | 128/146.2 |
| 4,103,058 | A | | 7/1978 | Humlicek | 428/171 |
| D270,110 | S | * | 8/1983 | Moore et al. | 128/201.15 |
| 4,467,799 | A | * | 8/1984 | Steinberg | 128/206.25 |
| 4,635,628 | A | | 1/1987 | Hubbard et al. | 128/201.17 |
| 4,688,566 | A | | 8/1987 | Boyce | 128/206.19 |
| 4,850,347 | A | | 7/1989 | Skov | 128/206.16 |
| 4,944,294 | A | * | 7/1990 | Borek | 128/201.15 |
| 4,966,140 | A | | 10/1990 | Herzberg | 128/206.19 |
| 5,025,506 | A | | 6/1991 | Huang | 2/206 |
| 5,467,765 | A | * | 11/1995 | Maturaporn | 128/206.19 |
| 5,592,938 | A | * | 1/1997 | Scarberry et al. | 128/206.25 |
| 5,676,133 | A | * | 10/1997 | Hickle et al. | 128/206.25 |
| 5,803,075 | A | * | 9/1998 | Yavitz | 128/206.25 |
| 5,813,398 | A | * | 9/1998 | Baird et al. | 128/201.17 |

FOREIGN PATENT DOCUMENTS

| | | |
|---|---|---|
| EP | 0 776 616 A2 | 9/1997 |

* cited by examiner

*Primary Examiner*—John G. Weiss
*Assistant Examiner*—V. Srivastava
(74) *Attorney, Agent, or Firm*—John A. Burtis

(57) ABSTRACT

A face mask is disclosed that includes a mask portion, a resilient member (e.g., a pillowed web), and, optionally, an adhesive portion. The resilient member and the adhesive portion are alternately positionable between the mask portion and the wearer to inhibit the passage of vapor between the mask and the wearer, which prevents fogging of the wearer's eyewear. A method for using the face mask is also disclosed.

28 Claims, 7 Drawing Sheets

ANTI-FOG FACE MASK

BACKGROUND OF THE INVENTION

The present invention relates to inhibiting the passage of moisture between a face mask and a wearer's face.

Face masks serve many purposes including protecting the wearer from environmental contaminants and protecting those with whom the wearer comes into contact from the wearer's exhaled breath. It is often desirable to wear eyewear such as glasses, safety goggles, and face shields in conjunction with a face mask to obtain additional protection. Unfortunately, warm, moist air escaping from the face mask tends to condense on eyewear causing fogging and, consequently, impairing visibility.

SUMMARY OF THE INVENTION

In one aspect, the invention features a face mask that includes a mask portion, a resilient member, and an adhesive portion. The resilient member and the adhesive portion are alternately positionable against the wearer (e.g., between the mask portion and the wearer), preferably to inhibit the flow of vapor between the mask and the wearer. The resilient member and the adhesive portion are also alternately positionable against the wearer to inhibit the flow of vapor between the positioned resilient member or adhesive portion and the wearer.

The resilient member is preferably foldable such that, when folded, the resilient member is positionable between the mask portion and the wearer. In one embodiment, the resilient member is foldable onto the mask portion. The resilient member can also be folded onto itself. In other embodiments, when the resilient member is folded, the adhesive portion is disposed between the resilient member and the mask portion. In some embodiments, the resilient member overlies the adhesive portion. When folded, the resilient member has a propensity to unfold.

In one embodiment, the resilient member includes a resilient exterior surface and an interior surface, and the adhesive portion is disposed on the interior surface of the resilient member. The mask can further include a second adhesive portion disposed on the resilient exterior surface of the resilient member. In other embodiments, the adhesive portion is disposed on the interior face-contacting surface of the mask portion.

The mask portion includes a major exterior mask surface, a major interior face-contacting surface, and an edge common to the interior and exterior mask surfaces. In one embodiment, the resilient member is affixed to the exterior mask surface and is dimensioned to be foldable over the common edge such that, when folded, the major interior surface of the resilient member is positionable against the wearer.

In preferred embodiments, the resilient member includes compacted higher density regions and pillowed lower density regions. The pillowed lower density regions are preferably displaced to one side of a plane defined by the base of the compacted higher density regions. The resilient member includes a matrix that includes the pillowed lower density regions and the compacted higher density regions. The compacted higher density regions preferably form a tortuous path.

One example of a useful resilient member is a nonwoven web that includes pressure sensitive adhesive microfibers.

The face mask can further include a variety of other components including a conformable strip (e.g., a conformable metal). The conformable strip can be disposed on the resilient member or affixed to the mask portion. The face mask can also include a release liner overlying the adhesive portion. In some embodiments, the resilient member is disposed on the release liner and is removable from the mask with the release liner to expose the adhesive portion.

In one embodiment, the face mask includes a filter, a resilient member of pillowed lower density regions and compacted higher density regions affixed to the filter, and an adhesive portion disposed on the resilient member.

In a second aspect, the invention features a face mask that includes a mask portion and a pillowed web affixed to the mask portion. The pillowed web includes a plurality of pillowed lower density regions and compacted higher density regions.

In a third aspect, the invention features a method for using the above-described face mask. The method includes selecting one of either the resilient member or the adhesive portion, and contacting a wearer with the selected resilient member or adhesive portion to form a seal between the mask and the wearer. Preferably the contacting forms a vapor barrier to inhibit the passage of moisture between the mask and the wearer.

The face mask provides a wearer with a choice between two alternate mechanisms for preventing the fogging of the wearer's eyewear in a single mask.

Other features and advantages of the invention will become apparent from the following description of the preferred embodiments thereof, and from the claims.

DESCRIPTION OF THE PREFERRED EMBODIMENTS

The face mask includes at least one anti-fog option for inhibiting the passage of moisture between the face mask and the wearer. When two or more anti-fog options are available, the options can be employed independently of each other and according to the wearer's preference.

Figure 1:
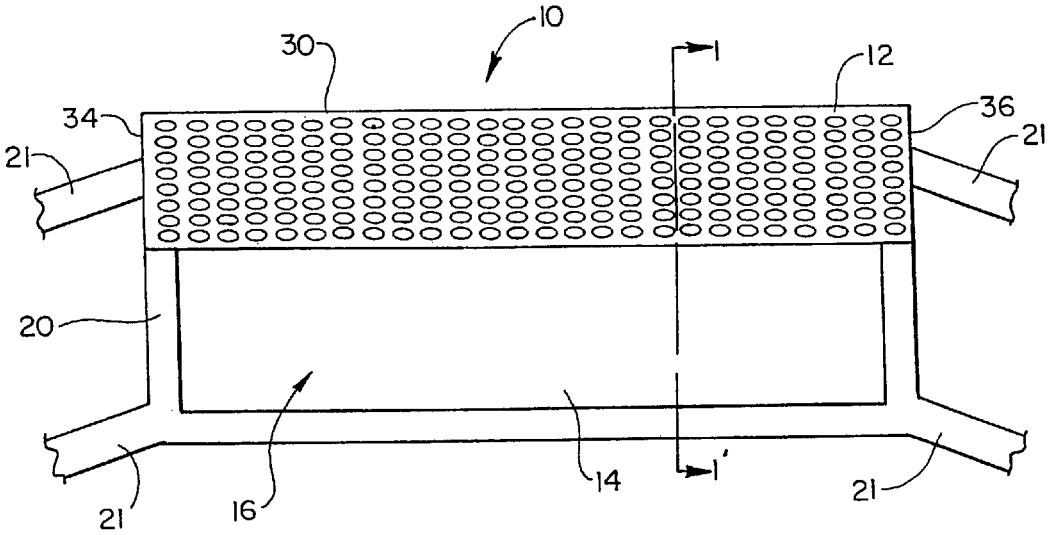
FIG. 1 is a plan view of the exterior surface of a face mask embodying the present invention.
Figure 2:
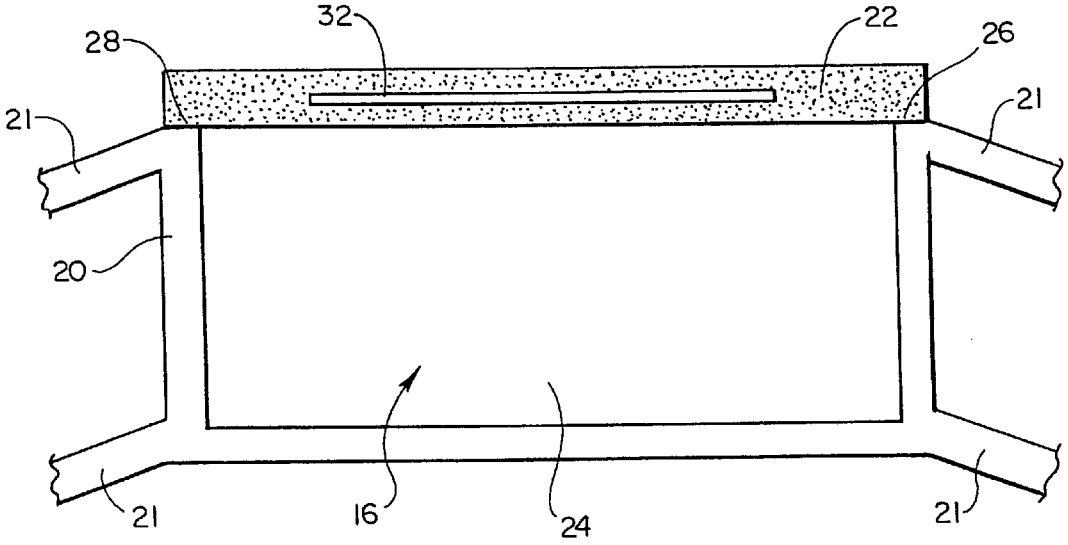
FIG. 2 is a plan view of the interior face-contacting surface of the face mask of FIG. 1.
Figure 3:
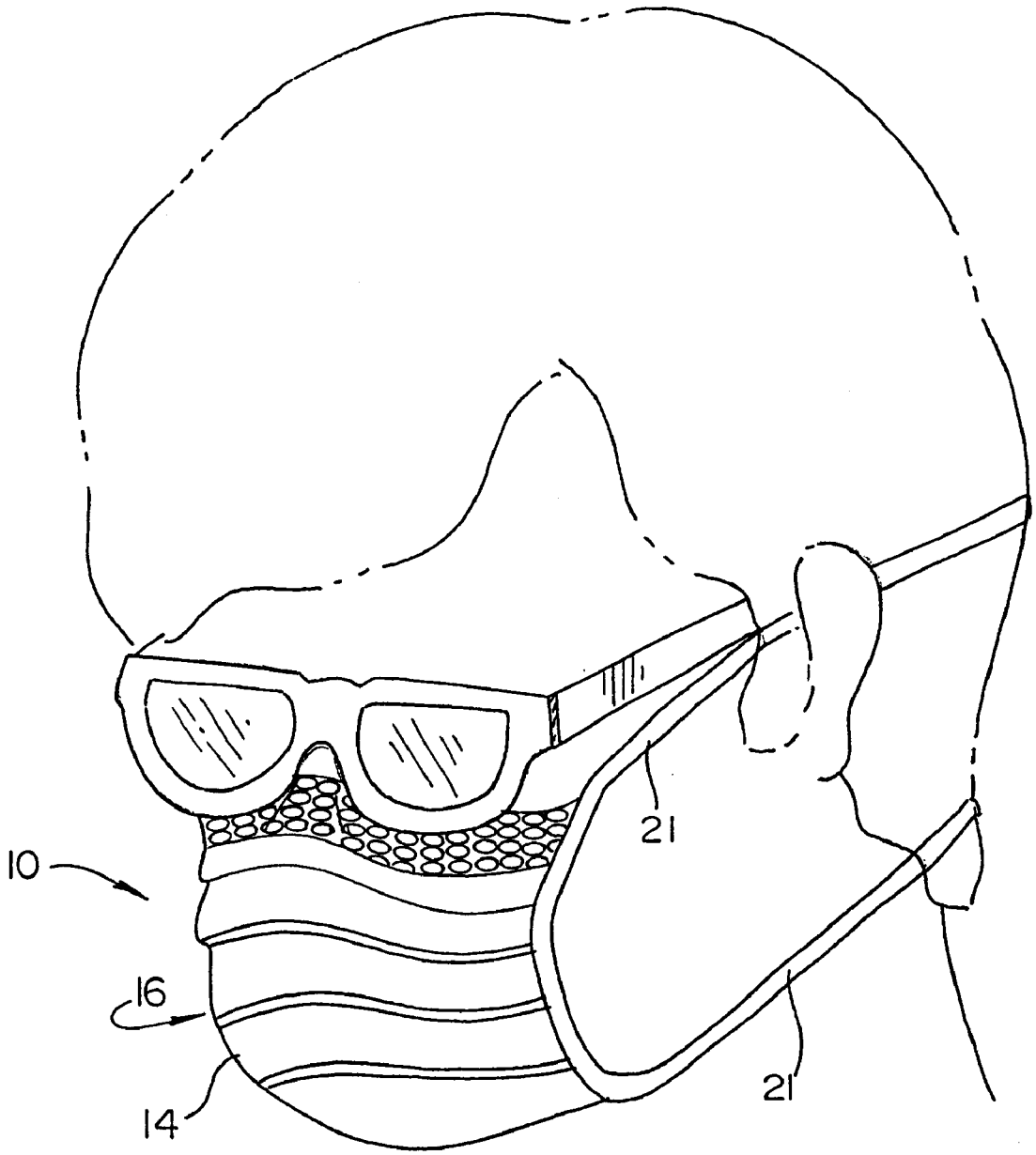
FIG. 3 is a perspective view of the mask of FIGS. 1 and 2 positioned on a wearer's face, which is outlined in phantom.

Referring to FIGS. 1–4, face mask 10 includes mask portion 16, resilient member 12, and, optionally, adhesive portion 22. Resilient member 12 is positionable against a wearer's face to inhibit vapor, e.g., the moisture in exhaled breath, from passing between the face mask 10 and the wearer's face. When the resilient member 12 is positioned against a wearer's face, such as between the wearer's nose and eyes, as shown in FIG. 3, moisture from exhaled breath is prevented from exiting the mask in a manner that would cause fogging of the wearer's eyewear, e.g., eyeglasses, goggles, and face shields. The resilient member can assist in directing the exhaled breath into the layers of the mask, through the layers of the mask portion, into the loft of the resilient member, and into the space created at sides of the mask where the mask portion and wearer's face are not in sealing contact with each other.

An exterior view of face mask 10 is shown in FIG. 1. FIG. 2 is an interior view of face mask 10. Referring to FIGS. 1–4, mask portion 16 has two major surfaces i.e., a major interior or face-contacting surface 24 and a major exterior surface 14. Mask portion 16 can also include binding 20 along its peripheral edges. Binding 20 can extend from the corners of the mask to provide tie strings 21 that can be tied at the back of the head of the wearer to secure the mask in a desired position.

Mask portion 16 includes one or more layers of material. Useful layer materials provide a variety of properties to the mask including, e.g., filtering capabilities, liquid resistance, liquid impermeability, and liquid imperviousness, and combinations thereof. Suitable materials for use in the mask portion include standard face mask materials, e.g., woven and nonwoven fabrics (e.g., microfibrous webs).

Resilient member 12 compresses when a force is exerted upon it and preferably substantially regains its original structure when the force is released. Resilient member 12 has at least one major exterior surface 30, shown in FIG. 1, that is resilient and a major interior surface 28, shown in FIG. 2. Resilient member 12 is foldable (i.e., is capable of being doubled over on itself without breaking, tearing, rupturing or significant loss of structural integrity) into position between the mask portion and the wearer as shown, e.g., in FIG. 4*b*. Resilient member preferably exhibits a propensity to unfold when the force holding the resilient member in a folded configuration is removed. For example, when resilient member 12 is folded and placed against a wearer's face, resilient member 12 will partially unfold against the wearer's face, which causes a pressure to be applied against the resilient member and the wearer's face, further enhancing the efficiency of the vapor inhibiting function of the resilient member.

Resilient member 12 can be positioned on the mask portion in a variety of configurations. For example, resilient member 12 can be affixed to the major exterior surface 14 of mask portion 16 along opposing edges 34, 36 so that major exterior surface 14 of mask portion 16 and the interior surface 28 of the resilient member are in facing relation with each other, as shown in FIGS. 4*a*, 4*b*, 9*a*, 9*b* and 13. Resilient member 12 can also be affixed to the interior face-contacting surface 24 of mask portion 16 as shown in FIGS. 11–16. Alternatively, resilient member 12 can be an extension of the mask portion.

Figure 4A:
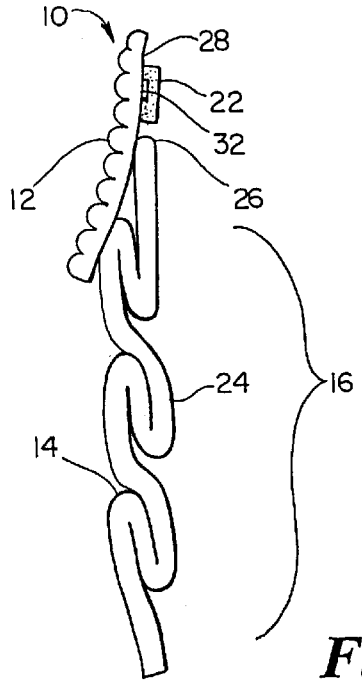
FIG. 4*a* is a cross-section view taken along line 1–1' of the mask of FIG. 1.
Figure 4B:
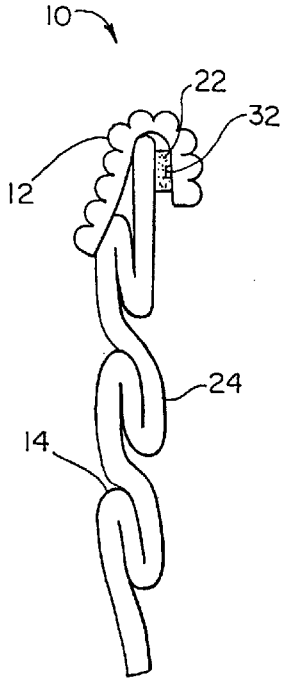
FIG. 4*b* is the mask of FIG. 4*a* with the exception that the resilient member has been folded over the edge of the face mask.

Referring to FIGS. 4*a* and 4*b*, resilient member 12 is dimensioned to be foldable over edge 26 such that a sufficient amount of resilient member 12 is available for contact with a wearer's face to form a vapor barrier between the wearer's face and the mask.

Figure 5B:
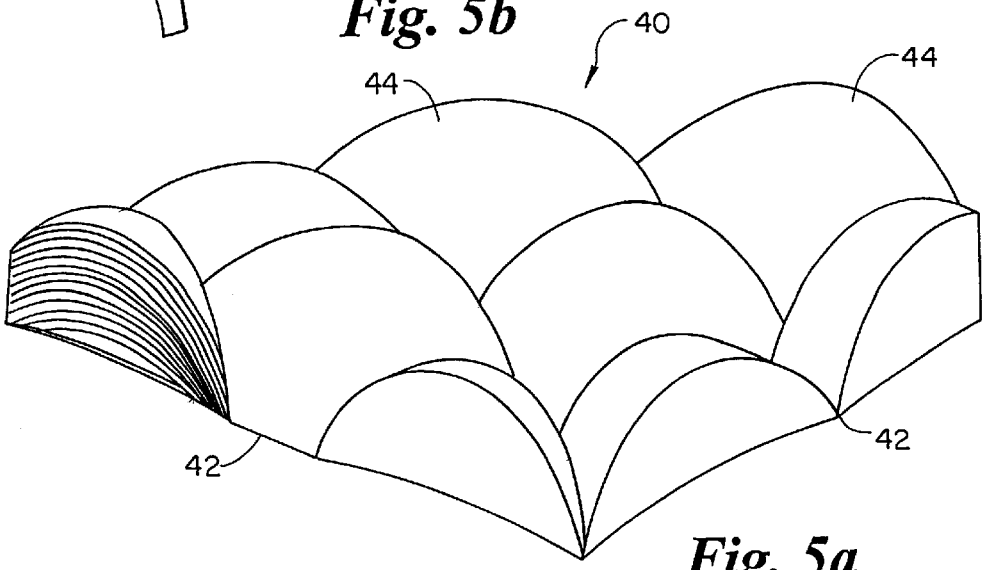
FIG. 5*b* is a perspective view partially in section of a portion of the illustrative pillowed microfiber web of FIG. 5*a*.
Figure 5A:
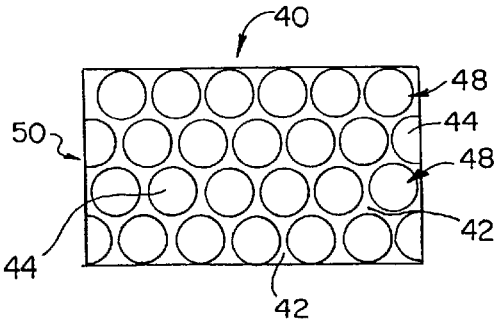
FIG. 5*a* is a plan view of an illustrative pillowed microfiber web.

Suitable materials for use in forming the resilient member include, e.g., foams, woven fabrics, and non-woven fibrous mats (e.g., microfiber webs). Preferred resilient materials are soft and pillowed, e.g., those webs having a network of compacted higher density regions 42 and pillowed lower density regions 44, as shown in FIGS. 5*a* and 5*b*. The pillowed lower density regions 44 span the space between adjacent compacted regions 42. The pillowed lower density regions 44 are expanded and displaced away from a plane defined by the base of the compacted higher density regions 42 in an arched configuration. Preferably the pillowed lower density regions 44 are of a substantially uniform height so as to ensure that the crests of the pillowed regions will contact a wearer's skin, which will force the exhaled air to flow around the pillowed regions and along the desired random path. The pillowed lower density regions 44 and compacted higher density regions 42 can be formed in a variety of configurations including, e.g., irregularly aligned rows arranged such that the compacted higher density regions 42 form continuous nonlinear (e.g., tortuous) passageways. The pillowed lower density regions 44 and compacted higher density regions 42 can also be arranged in a matrix as shown, e.g., in FIG. 5*a*, wherein alternating rows (e.g., 48 and 50) are offset and define a random tortuous path of higher density regions 42. Examples of suitable pillowed webs are described in U.S. Pat. No. 4,103,058.

The pillowed non-woven web may be formed using conventional techniques for preparing blown microfibers, such as melt blowing, solution blowing, and air laying. Preferably the pillowed web is prepared by melt blowing. Melt-blown microfiber webs can be prepared, for example, by the methods described in Wente, Van A., "Superfine Thermoplastic Fibers," *Industrial Engineering Chemistry,* Vol. 48, pp. 1342–46: Report No. 4364 for the Naval Research Laboratories, Published May 25, 1954, entitled, "Manufacture of Superfine Organic Fibers," by Wente et al.: and in U.S. Pat. Nos. 3,971,373 (Braun), 4,100,324

(Anderson), 4,429,001 (Kolpin et al.), and 3,704,198 (Prentice). In addition, U.S. Pat. No. 4,103,058 (Humlicek) describes methods of making pillowed webs using melt-blown and solution-blown techniques.

The pillowed web for resilient member 12 may also be formed by collecting blown microfibers on variously dimensioned screens. Such screens include those screens that are perforated so that microfibers deposited on the land area of the screen form the compacted higher density regions and microfibers deposited over the openings of the screen form the pillowed lower density regions.

Figure 6:
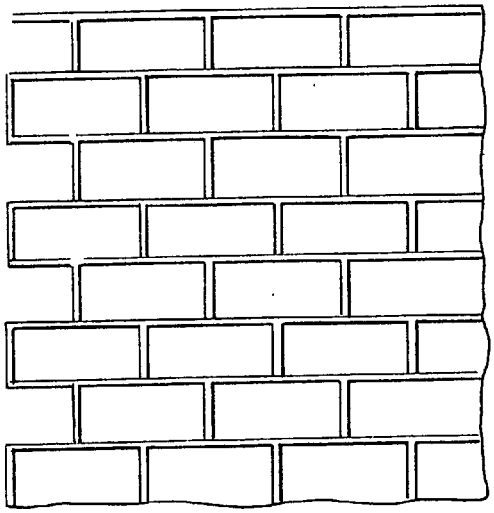
FIGS. 6–8 are plan views of portions of collection screen patterns useful for making the pillowed webs.
Figure 7:
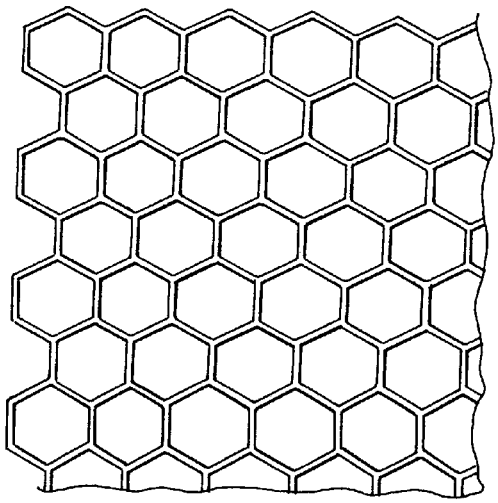
Figure 8:
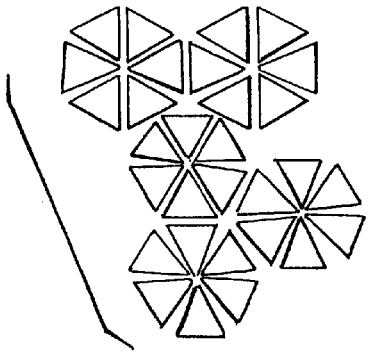

Suitable collection screens are those in which the land area has connected linear areas, which vary in width up to 5 millimeters or more. Such collection screens generally provide webs of low overall density with good web integrity. The land area of useful collection screens can vary widely, from as little as 0.1% to 90% of the whole area of the screen. Preferably the land area is less than about 60% of the whole area of the screen, and can be about 1–5%. Where the land area is small, the opening size in the screen may also be small, for example, as small as 1 or 2 millimeters though it is usually 3 millimeters or more. Preferably the land area is minimized so as to provide a web with the lowest overall density and good web integrity. Useful collection screens can include a variety of patterns including those patterns shown in FIGS. 6–8.

The bulk of microfibers collected in a melt-blown operation have a mean fiber diameter less than about 10 $\mu$m. The density of the pillowed regions vary depending upon the height of the pillowed regions, the collection distance, the velocity of the gaseous stream carrying the microfibers to the collector, the rate at which the collection screen is moved through the gaseous stream, and the ratio of gas to polymer passed through the extrusion apparatus. The density of the pillowed regions can be varied. Useful webs have pillowed regions having a density of no greater than about 0.02 g/cc.

The density of the compacted regions can also be varied somewhat but generally is at least about 0.2 g/cc. The ratio of the densities of the pillowed lower density regions to compacted higher density regions can be varied. Generally the ratio of the densities (lower density regions to higher density regions) is at least about 1:1, more preferably at least about 20:1, most preferably 30:1 or more.

The non-woven fibrous web may include polymeric microfibers, staple fibers, continuous fiber filament, or a combination thereof, with polymeric microfibers being preferred. Preferred polymers for forming fibers used in the construction of resilient member 12 include any fiber forming polymers that are capable of liquification, e.g., melting or dissolving, to the point where the viscosity of the polymer is sufficient for use in microfiber blowing operations. A preferred polymer for melt-blown microfibers is polypropylene. Other suitable polymers for melt-blown microfibers include, e.g., polyurethanes, polyolefins such as polypropylene, polyethylene, metallocene catalyst polyolefins, polyesters such as polyethylene terephthalate, polyamides such as nylon 6 and nylon 66, block copolymers such as, e.g., styrene-butadiene-styrene and styrene-isoprene-styrene (commercially available under the trade designation Kraton from Shell Chemical Co.), ethylene vinyl acetate, neoprene, natural rubber, polyvinyl acetate and its hydrolyzed derivatives, silicones, and derivatives thereof. Examples of polymers suitable for solution-blowing include such polymers as polyvinylchloride, polystyrene, polyarylsulfone, and combinations thereof. Inorganic materials may also be used to form the blown microfibers.

Face mask 10 can include an adhesive portion 22 for providing a second anti-fog option, as shown in FIGS. 2, 4*a*, 4*b*, and 9–11. Adhesive portion 22 is located on face mask 10 in such a way that the adhesive portion is positionable against a wearer to inhibit the flow of vapor between face mask 10 and the wearer. For example, adhesive portion 22 can be disposed on interior surface 24 of mask portion 16 (e.g., as shown in FIGS. 9*a*, 9*b*, 10*a* and 11), on a major surface 28, 30 of the resilient member 12 (e.g., as shown in FIGS. 4*a* and 4*b*), and in various combinations thereof.

Referring to FIG. 4*a*, adhesive portion 22 is disposed on face mask 10 such that resilient member 12 and adhesive portion 22 are alternately positionable against a wearer's face. In FIGS. 2 and 4*a* adhesive portion 22 is in the form of an adhesive strip positioned along the top edge of mask 10 on interior surface 28 of resilient member 12. When worn, the adhesive portion is positioned across the nose in an area located between the wearer's eyes and the nostrils. Once positioned, the adhesive portion is pressed into contact with the wearer's skin to form a seal. The seal assists in inhibiting the flow of moisture between the face mask and the wearer's eyes, which inhibits fogging of the wearer's eyewear.

Adhesive portion 22 exhibits properties of adhesion, cohesion, stretchiness, and elasticity sufficient to seal the mask to a wearer's face such that when the adhesive is positioned between the wearer's nose and eyes exhaled breath cannot pass between the mask and the wearer's skin in sufficient quantities to fog the user's eyewear. The adhesive portion can be in a variety of forms including, e.g., a strip of adhesive composition, adhesive foam, pressure sensitive adhesive microfibers, and combinations thereof. Examples of suitable adhesive compositions include polyacrylate, polyurethane, natural rubber, polyisobutene, polybutadiene block copolymers such as, e.g., styrene-polybutadiene and styrene-isoprene block copolymers available under the Kraton trade designation, silicone based adhesive compositions, and combinations thereof. Useful adhesive compositions include those adhesive compositions described in U.S. Pat. No. 5,648,166, and acrylate based adhesives available from National Starch Adhesives. These adhesives may optionally include additives such as plasticizers, tackifiers, and fillers.

Adhesive portion 22 can also be in the form of a plurality of pressure-sensitive adhesive microfibers located on or constituting at least a portion of the resilient member. The pressure-sensitive adhesive microfibers render the resilient member tacky and capable of adhesion to a wearer. Examples of useful pressure-sensitive adhesive microfibers and webs made from such microfibers are described in U.S. Pat. No. 5,957,126.

Optionally, the mask can include a conformable strip 32, e.g., a band, strip or wire, that is capable of being conformed, bent, shaped or molded, to the contours of a wearer's face, as shown in FIG. 2, in phantom in FIG. 3, and in cross-section in FIGS. 4*a*, 4*b*, 9*a* and 9*b*. Conformable strip 32 can assist in forming a seal between the mask portion and the wearer's face. Conformable strip 32 can be positioned on the mask or in the mask in a variety of configurations including, e.g., positioned between adhesive portion 22 and interior face-contacting surface 28 of resilient member 12 (e.g., FIGS. 4*a* and 4*b*), between layers of the mask portion, and on the exterior surface of the mask. Suitable materials for the conformable strip include, e.g., metal strips, bands, or wires, and plastic coated metal strips, bands or wires. The mask can also include a strip of adhesive that enhances nasal clearance.

Other embodiments are within the claims. Examples of other embodiments of face masks are also shown in cross-section in FIGS. 9*a*–17. Features that are in common with mask 10 shown in FIGS. 1–4 are designated with the same reference numerals.

Figure 9A:
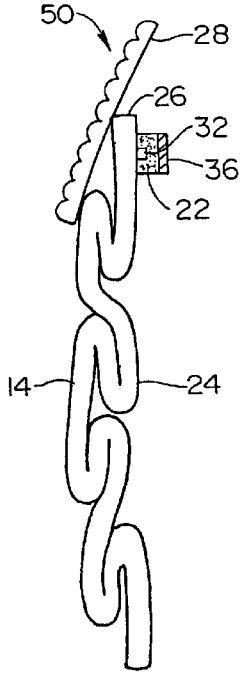
FIG. 9*a* is a cross-section view taken along line 1–1' of a face mask according to a second embodiment of the present invention.

Referring to FIG. 9*a,* face mask 50 includes resilient member 12 extending beyond edge 26, and cover 36 (e.g., a release liner) overlying and coextensive with adhesive portion 22. Cover 36 preferably has a low adhesion factor and overlies adhesive portion 22 to preserve and protect the adhesive properties of the adhesive portion. Cover 36 can be peeled back from adhesive portion 22 and removed when the user desires to utilize adhesive portion 22 as a vapor barrier. Preferred cover materials are flexible. Suitable cover materials include paper, plastic, plastic coated papers, and plastic coated papers treated to reduce surface energy, e.g., silicone, hydrocarbon, and fluorocarbon treated materials, and combinations thereof. Cover 36 can also be in the form of a strip of netting.

Figure 9B:
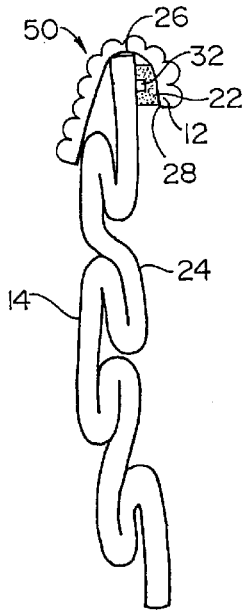
FIG. 9*b* is the mask of FIG. 9*a* with the exception that the resilient member has been folded over the edge of the mask and the release liner has been removed.

In FIG. 9*b,* cover 36 has been removed and resilient member 12 is folded over onto mask portion 16 such that adhesive portion 22 is sandwiched between the interior surface 28 of resilient member 12 and the interior face-contacting surface 24 of mask portion 16. When resilient member 12 is folded into contact with adhesive portion 22, the adhesive characteristics of adhesive portion 22 can assist in maintaining the resilient portion in a folded construction.

Figure 10B:
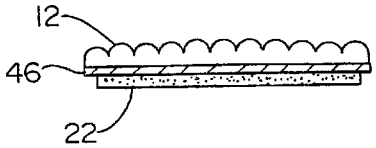
FIG. 10*b* is a side view of an arrangement of a resilient member, a release liner, and an adhesive portion of the face mask of FIG. 10*a*.
Figure 10A:
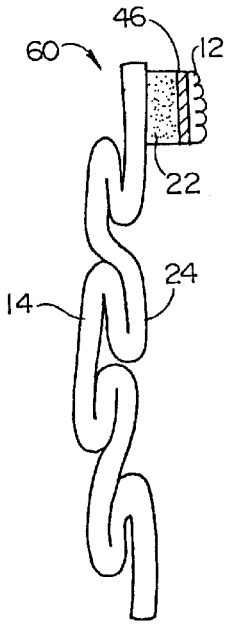
FIG. 10*a* is a cross-section view taken along line 1–1' of a face mask according to a third embodiment of the present invention.

FIGS. 10*a* and 10*b* show another embodiment of face mask 60 in which resilient member 12 is affixed to a release liner 46 positioned between adhesive portion 22 and resilient member 12. Resilient member 12 and release liner 46 can be peeled away to expose adhesive portion 22. The exposed adhesive portion 22 is then available for positioning against the wearer.

Figure 11:
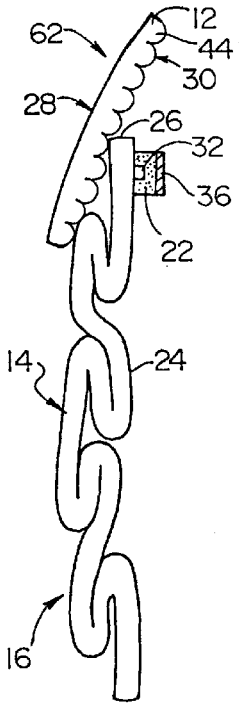
FIG. 11 is a cross-section view taken along line 1–1' of a face mask according to a fourth embodiment of the present invention.

Referring to FIG. 11, face mask 62 includes resilient member 12 positioned such that resilient major surface 30 is affixed to exterior surface 14 of mask portion 16. Resilient member 12 is foldable over edge 26 of mask portion 16. When in a folded configuration, adhesive portion 22 is enveloped by resilient member 12 such that major surface 28 of resilient member 12 is available for contact with the wearer.

Figure 12:
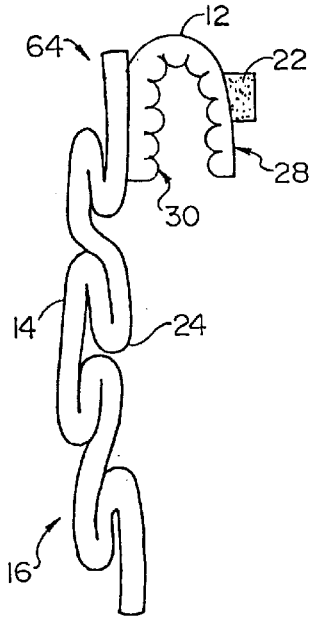
FIG. 12 is a cross-section view taken along line 1–1' of a face mask according to a fifth embodiment of the present invention.

Face mask 64, shown in FIG. 12, includes resilient member 12 secured to interior surface 24 of mask portion 16, and adhesive portion 22. When resilient member 12 is in a folded position, resilient surface 30 of resilient member 12 is in facing relation with itself, and major surface 28 of resilient member 12 is available for contact with the wearer.

Figure 13:
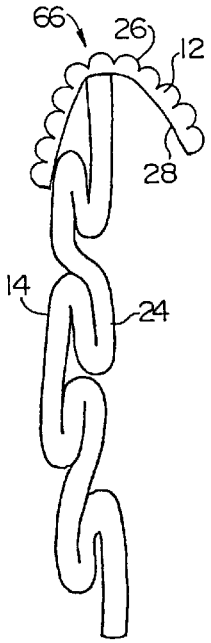
FIG. 13 is a cross-section view taken along line 1–1' of a face mask according to a sixth embodiment of the present invention.
Figure 14:
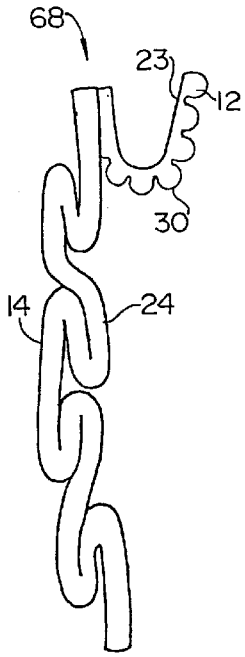
FIG. 14 is a cross-section view taken along line 1–1' of a face mask according to a seventh embodiment of the present invention.
Figure 15:
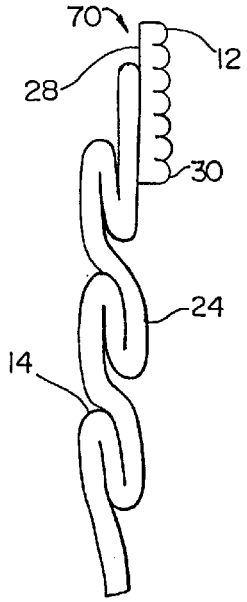
FIG. 15 is a cross-section view taken along line 1–1' of a face mask according to a eighth embodiment of the present invention.

Other face masks 66, 68, and 70 are shown in FIGS. 13–15. Face masks 66, 68 and 70 include mask portion 16, major exterior surface 14, major interior surface 24, and resilient member 12. The various major surfaces 28, 30 of resilient member 12 are shown affixed to the exterior surface 14 (FIG. 13) or interior surface 24 (FIGS. 14 and 15) of mask portion 16.

Figure 16:
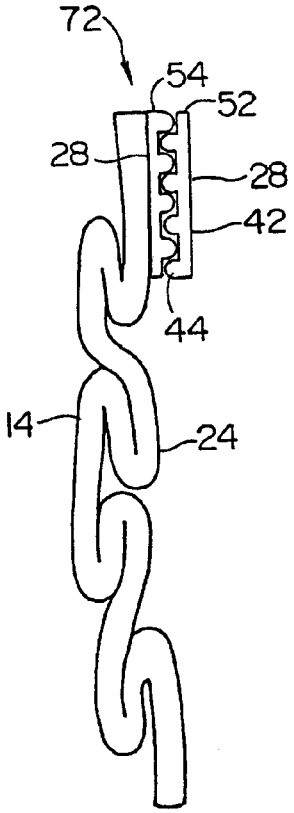
FIG. 16 is a cross-section view taken along line 1–1' of a face mask according to a ninth embodiment of the present invention.
Figure 17:
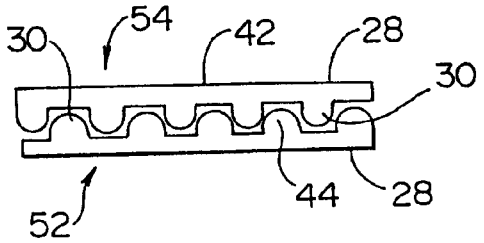
FIG. 17 is an enlarged view of the two interlocking pillowed webs shown in crosssection in FIG. 16.

Referring to FIGS. 16 and 17, face mask 72 shown in cross-section includes two resilient members 52, 54 having pillowed lower density regions 44 and compacted higher density regions 42 arranged in an interlocking relationship with each other and secured to interior surface 24 of mask portion 16. Major surface 28 of resilient member 52 is available for contact with the wearer.

Figure 18A:
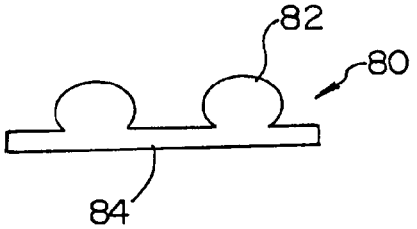
FIG. 18*a* is a cross-section view of another illustrative pillowed web.
Figure 18B:
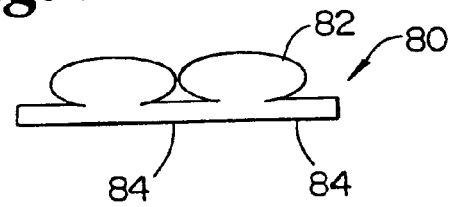
FIG. 18*b* is the pillowed web of FIG. 18*a* in a compressed configuration.

Referring to FIG. 18*a,* another resilient member 80 is shown in which the pillowed lower density regions 82 are generally spherical in shape. When compressed against a surface, spherical pillowed lower density regions 82 are pressed into the space above compacted higher density regions 84, as shown in FIG. 18*b*. When pillowed lower density regions 82 are compressed, the paths formed by compacted higher density regions 84 become obstructed. Exhaled breath travelling along the paths formed by compacted higher density regions 84 encounters the bulk of pillowed lower density regions 82 and is forced into pillowed lower density regions 82.

What is claimed is:

1. A face mask comprising:

(a) a mask portion;

(b) a resilient member comprising compacted higher density regions and pillowed lower density regions; and (c) an adhesive portion, said resilient member and said adhesive portion being alternately positionable against the wearer.

2. The face mask of claim 1, wherein said resilient member and said adhesive portion are alternately positionable against the wearer to inhibit the flow of vapor between the mask and the wearer.

3. The face mask of claim 1, wherein said resilient member and said adhesive portion are alternately positionable against the wearer to inhibit the flow of vapor between the positioned resilient member or adhesive portion and the wearer.

4. The face mask of claim 1, wherein said resilient member is foldable such that, when folded, said resilient member is positionable between said mask portion and the wearer.

5. The face mask of claim 1, wherein said resilient member is foldable onto said mask portion such that, when folded, said resilient member is positionable between said mask portion and the wearer.

6. The face mask of claim 1, wherein said resilient member is foldable onto itself such that, when folded, said resilient member is positionable between said mask portion and the wearer.

7. The face mask of claim 1, wherein said resilient member is foldable such that, when folded, said adhesive portion is disposed between said resilient member and said mask portion.

8. The face mask of claim 1, wherein said resilient member, when folded, has a propensity to unfold.

9. The face mask of claim 1, wherein said resilient member overlies said adhesive portion.

10. The face mask of claim 1, wherein said resilient member comprises a resilient exterior surface and an interior surface, said adhesive portion being disposed on said interior surface of said resilient member.

11. The face mask of claim 10 further comprising a second adhesive portion disposed on said resilient exterior surface of said resilient member.

12. The face mask of claim 1, wherein said mask portion has an interior face-contacting surface, said adhesive portion being disposed on said interior face-contacting surface of said mask portion.

13. The face mask of claim 1, wherein said mask portion comprises:

a major exterior surface;

a major interior face-contacting surface; and an edge common to said interior and exterior surfaces, said resilient member being affixed to said exterior surface of said mask portion and dimensioned to be foldable over said common edge such that, when folded, the major interior surface of said resilient member is positionable against the wearer.

14. The face mask of claim 1, wherein said pillowed lower density regions are displaced to one side of a plane defined by the base of said compacted higher density regions.

15. The face mask of claim 1, wherein said resilient member comprises a matrix comprising said pillowed lower density regions and said compacted higher density regions.

16. The face mask of claim 1, wherein said compacted higher density regions form a tortuous path.

17. The face mask of claim 1, wherein said resilient member comprises a nonwoven web comprising pressure sensitive adhesive microfibers.

18. The face mask of claim 1 further comprising a conformable strip.

19. The face mask of claim 18, wherein said conformable strip is disposed on said resilient member.

20. The face mask of claim 18, wherein said conformable strip is affixed to said mask portion.

21. The face mask of claim 18, wherein said conformable strip comprises a metal.

22. The face mask of claim 1 further comprising a release liner overlying said adhesive portion.

23. The face mask of claim 22, wherein said resilient member is disposed on said release liner, and is removable from the mask with said release liner to expose said adhesive portion.

24. A face mask comprising:

(a) a filter;

(b) a resilient member affixed to said filter, said resilient member comprising pillowed lower density regions and compacted higher density regions; and (c) an adhesive portion disposed on said resilient member, said resilient member and said adhesive portion being alternately positionable against the wearer to inhibit the passage of vapor between the mask and the wearer.

25. The mask of claim 24, wherein said resilient member is foldable such that, when folded, said pillowed lower density regions of said resilient member are positionable against the wearer.

26. The mask of claim 24, wherein said resilient member is affixed to an interior face-contacting surface of said filter.

27. A method for using a face mask, the face mask comprising a mask portion, a resilient member comprising compacted higher density regions and pillowed lower density regions, and an adhesive portion, said resilient member and said adhesive portion being alternately positionable between said mask portion and the wearer, said method comprising:

selecting said resilient member or said adhesive portion; and contacting a wearer with said selected said resilient member or said adhesive portion to form a seal between the mask and the wearer.

28. The method of claim 27, wherein said step of contacting forms a vapor barrier to inhibit the passage of moisture between the mask and the wearer.

* * * * *